US005651279A

United States Patent [19]

Berton et al.

[11] Patent Number: 5,651,279

[45] Date of Patent: Jul. 29, 1997

[54] KEY RESTRICTING DEVICE

[75] Inventors: Edward Berton, Apollo Beach; Richard Obarski, Sun City Center, both of Fla.

[73] Assignee: Richard W. Obarski, Sun City Center, Fla.

[21] Appl. No.: 514,316

[22] Filed: Aug. 11, 1995

[51] Int. Cl.[6] ..... E05B 13/00

[52] U.S. Cl. ..... 70/211; 70/416; 292/359

[58] Field of Search ..... 70/416, 211, 467, 70/212, 468, 429, 483, 430, 202; 292/289, 290, 153, 359, 296–298

[56] References Cited

U.S. PATENT DOCUMENTS

| | | | |
|---|---|---|---|
| 1,700,135 | 1/1929 | Lanes | 70/416 |
| 2,461,676 | 2/1949 | Budak | 70/416 |
| 3,423,974 | 1/1969 | Bernsley | 70/416 |
| 3,748,882 | 7/1973 | Dusault, Jr. et al. | 70/416 |
| 3,921,423 | 11/1975 | Hollins | 70/416 |
| 4,127,967 | 12/1978 | Franzl | 70/416 X |
| 4,700,556 | 10/1987 | Wade, Sr. et al. | 70/416 X |
| 5,003,803 | 4/1991 | Richards | 70/416 |
| 5,515,704 | 5/1996 | Van Nguyen . | |

FOREIGN PATENT DOCUMENTS

| | | | |
|---|---|---|---|
| 705176 | 6/1931 | France | 292/359 |
| 665769 | 1/1952 | United Kingdom | 70/416 |

OTHER PUBLICATIONS

Photographs of auxiliary locking device submitted to Schlage Lock Company in Oct., 1993.

*Primary Examiner*—Lloyd A. Gall
*Attorney, Agent, or Firm*—Lowe, Price, LeBlanc & Becker

[57] ABSTRACT

A voluntary key restricting device attached to the interior side of an entry door to prevent the unlocking of a cylinder locking dead bolt mechanism by any outside key or burglar cylinder lock picking device. This device will prevent a dead bolt knob from rotating regardless of the angular locked position of the knob without the addition or removal of supplemental parts. It is self contained, requires no tools to install, requires no modifications to an existing door and has a built in child deterrent locking feature.

5 Claims, 7 Drawing Sheets

KEY RESTRICTING DEVICE

BACKGROUND—FIELD OF INVENTION

This invention relates to a cylinder operated dead bolt lock used on an entry door in a home or apartment.

BACKGROUND—DESCRIPTION OF PRIOR ART

Most homes and apartments have a cylinder operated dead bolt lock on the front and rear entry doors. This type of security device is unlocked by a resident with the appropriate key, unfortunately this type of security lock can also be unlocked by anyone with an unauthorized duplicate key, master key, stolen key. Also the lock can picked from the outside to gain unlawful entry to the residence. A universal concern by residents that use a key operated cylinder dead bolt lock is that "someone has an unauthorized key". It would be beneficial to have a voluntary key restricting device adapted to an existing cylinder operated dead bolt lock. The key restricting device would prevent entry into the residence by use of a key or lock picking device inserted into the outside cylinder lock.

Inventors have created many different solutions to this problem. However, these devices are inadequate due to the complicated method of installation and limitations of operation.

U.S. Pat. No. 5,067,334 to Sorkilmo (1991) is a U shaped device that is tapered in thickness, it is designed to be wedged between the dead bolt knob called the operator handle and the dead bolt lock. This device requires the operator handle be in the horizontal position when the door is locked so that the U shaped wedge will be vertical, the inventor states gravity will increase the wedging action. The operator handle or dead bolt knob has a variety of positions when locked. If the operator handle is vertical when the door is locked, the device would have to be inserted in the horizontal position and would not be secure, gravity could act against the wedging action causing the device to fall to the floor. If the operator handle is close to the dead bolt lock there would be insufficient space to insert the device, also the device is removable and can easily be misplaced. This invention does not incorporate a child proof deterrent to discourage young children from inserting the device.

U.S. Pat. No. 5,052,202 to Murphy (1991) incorporates an inverted U shaped mechanism that is placed around a door knob, the top of the device has a cross shaped aperture to lock a vertical or horizontal dead bolt knob. If the locked position of the dead bolt knob is other than vertical or horizontal a different locking device is required. The locked position of a dead bolt knob can not be changed or adjusted to fit a particular locking device, the locked position of the dead bolt knob will vary with different manufactures. This invention requires additional parts or devices to accept the countless positions of a locked dead bolt knob. Also this device must be removed from the door to allow an individual to lock and unlock the cylinder operated dead bolt when leaving and returning home. It can be misplaced and does not provide any type of deterrent to prevent a small child from operating the invention.

U.S. Pat. No. 5,003,803 to Richards (1991) requires the existing dead bolt lock to be modified. Fastening screws or pins must be inserted into the face of the dead bolt lock. Hook and loop fastener or "VELCRO" type fastening is an alternate method of attaching the device to a door. If the dead bolt knob is close to the face of the dead bolt lock there would not be sufficient space or clearance to attach either hook or loop self-adhesive fastener and allow normal operation of the dead bolt knob. Adding fastening hardware to the dead bolt lock is beyond the expertise of the average home owner and would require the services of a locksmith or mechanically adept person. As with U.S. Pat. No. 5,052,202 this locking device has a removable part that can be misplaced.

U.S. Pat. No. 5,000,498 to Upchurch (1991) requires a hole be drilled in the door near the perimeter of the interior dead bolt lock. A clamp is permanently attached to the dead bolt knob and a retaining pin is inserted through the clamp into the pre-drilled hole in the door preventing the dead bolt knob and clamp from rotating. The retaining pin is removed to operate the dead bolt knob. This invention requires that a separate part be inserted into the door every time it is used. This part is very small and can easily be removed and ingested by a small child and can also be easily misplaced. An expertise with hand and small power tools is required to install this invention.

OBJECTS AND ADVANTAGES

The objects and advantages of this key restricting device are:

A. To provide a key restricting device that will prevent the rotation of a dead bolt knob regardless of the angular locked position of a knob.

B. To provide a key restricting device that does not require the addition or removal of supplemental parts.

C. To provide a key restricting device that does not require and is not affected by the force of gravity.

D. To provide a key restricting device that does not require hand tools or special expertise to install.

E. To provide a key restricting device that does not require modifications to an existing dead bolt lock or door.

F. To provide a key restricting device that incorporates a child deterrent feature to render the device very difficult to manipulate successfully by small children.

G. To provide a key restricting device that is permanently attached to a door and does not have to be removed or any part of the device removed to lock, unlock or rotate a dead bolt knob.

H. To provide a key restricting device that does not require complicated thought or procedure to unlock in an emergency.

I. To provide a key restricting device that protects the occupants and the contents of a dwelling. In addition, the contents could be protected when occupants are away from the dwelling if there is an alternate available entry such as an electric garage door opener.

Further objects and advantages of this invention will be evident in the following drawings and descriptions.

DRAWING FIGURES

| Reference Numbers In Drawings | |
|---|---|
| 15 edge of door | 25 restraining plate stop |
| 16 inside face of door | 26 child proof latch |
| 17 dead bolt | 27 adhesive |
| 18 dead bolt knob | 28 outside face of door |
| 19 key restricting device | 29 outside cylinder lock |
| 20 base plate | 30 inside cylinder lock |
| 21 hinged restraining plate | 31 cylinder lock key |
| 22 hinge pin | 32 positioning spring stop |
| 23 positioning spring | 33 hinge pin support |
| 24 child proof latch hook | 34 restricting edge |
| | 35 position arc |

DESCRIPTION

Figure 1:
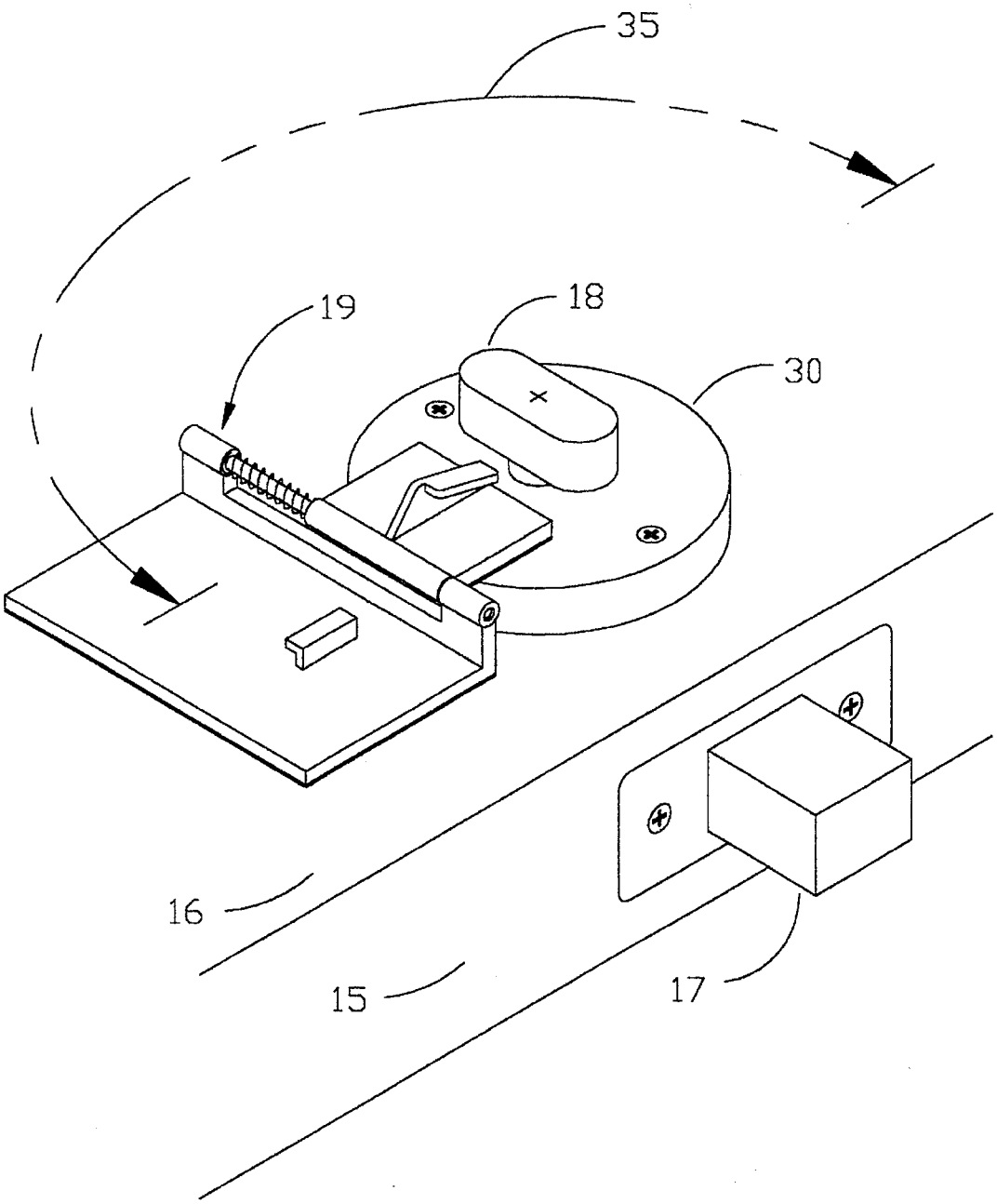
FIG. 1 is an isometric view of the key restricting device, cylinder lock, dead bolt knob and dead bolt, the key restricting device is in the closed or locked position.
Figure 1A:
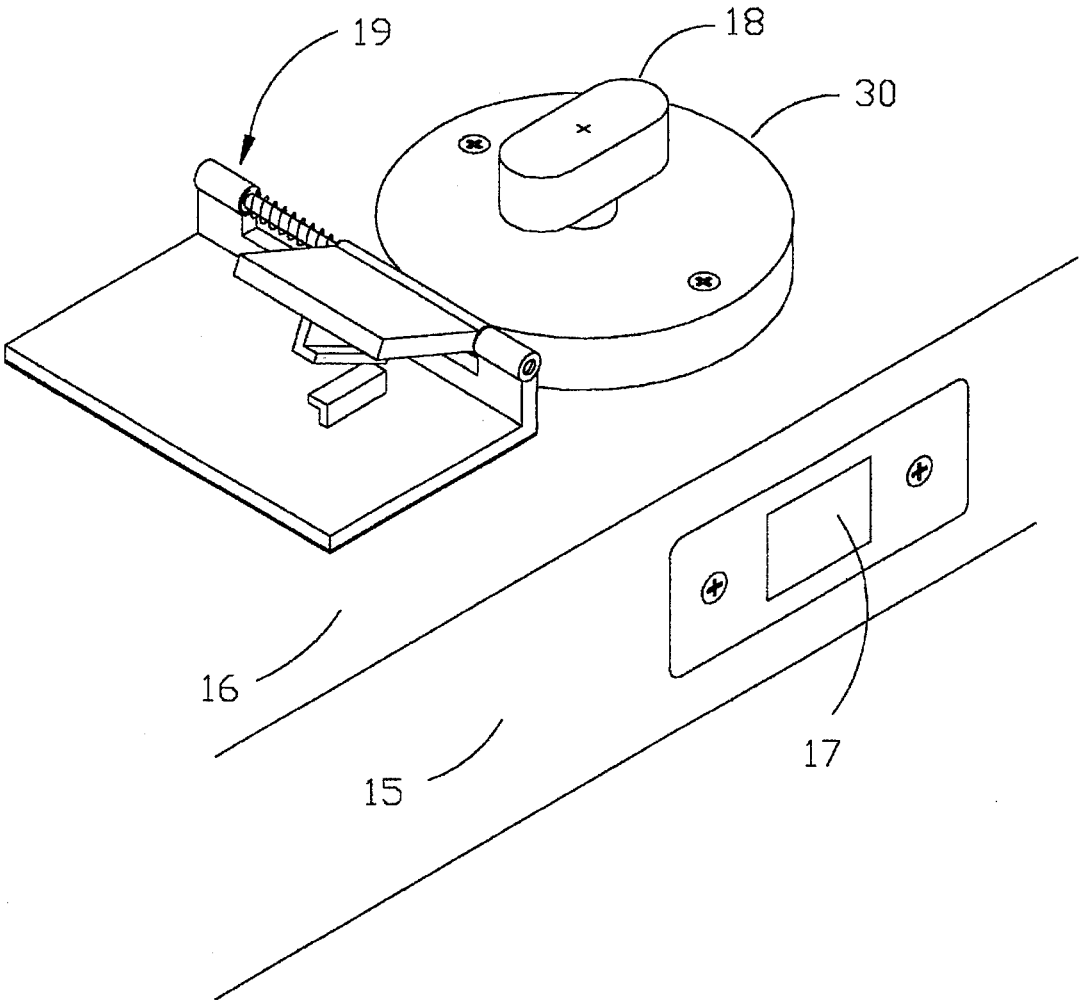
FIG. 1A is similar to FIG. 1 except the key restricting device is in the open or unlocked position.
Figure 1B:
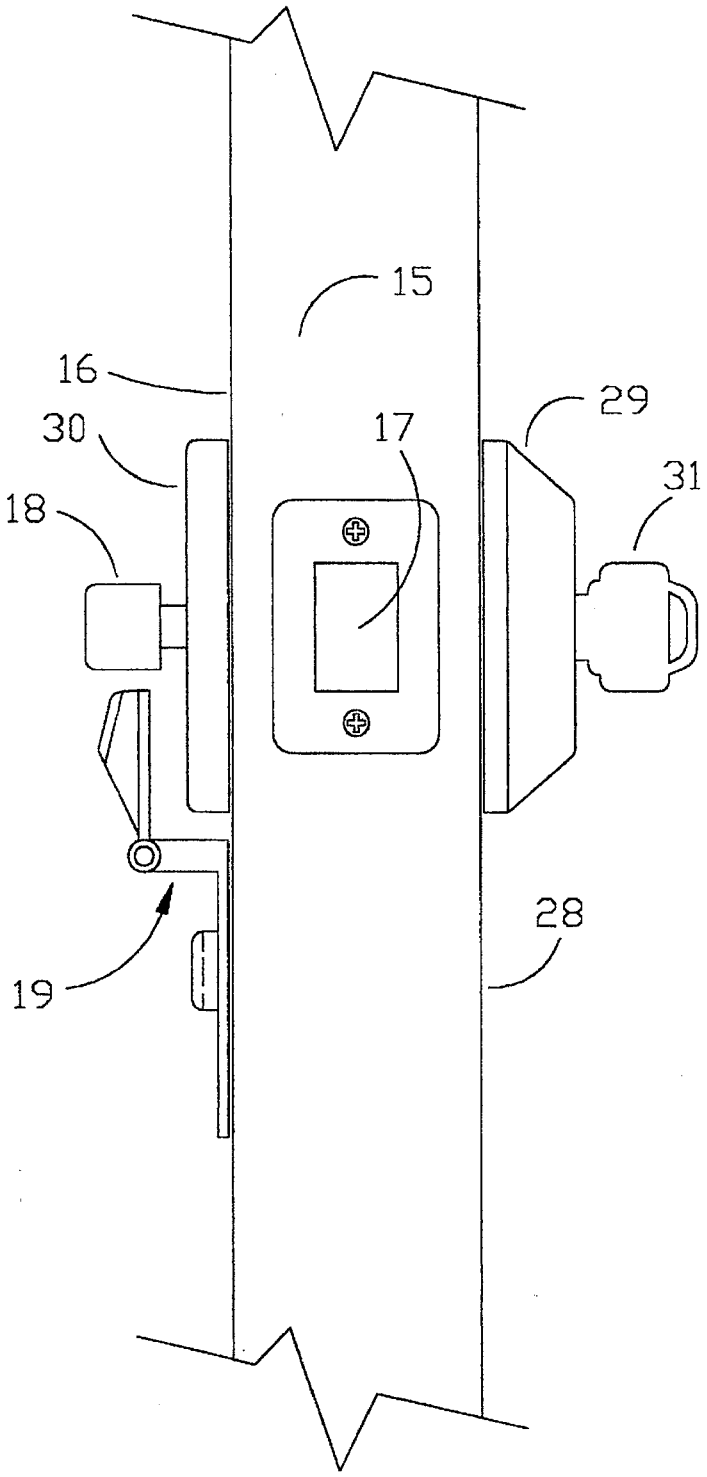
FIG. 1B is a side view of an entry door showing the relationship of a key restricting device to various cylinder lock components also the inside and outside surfaces of an entry door.
Figure 2:
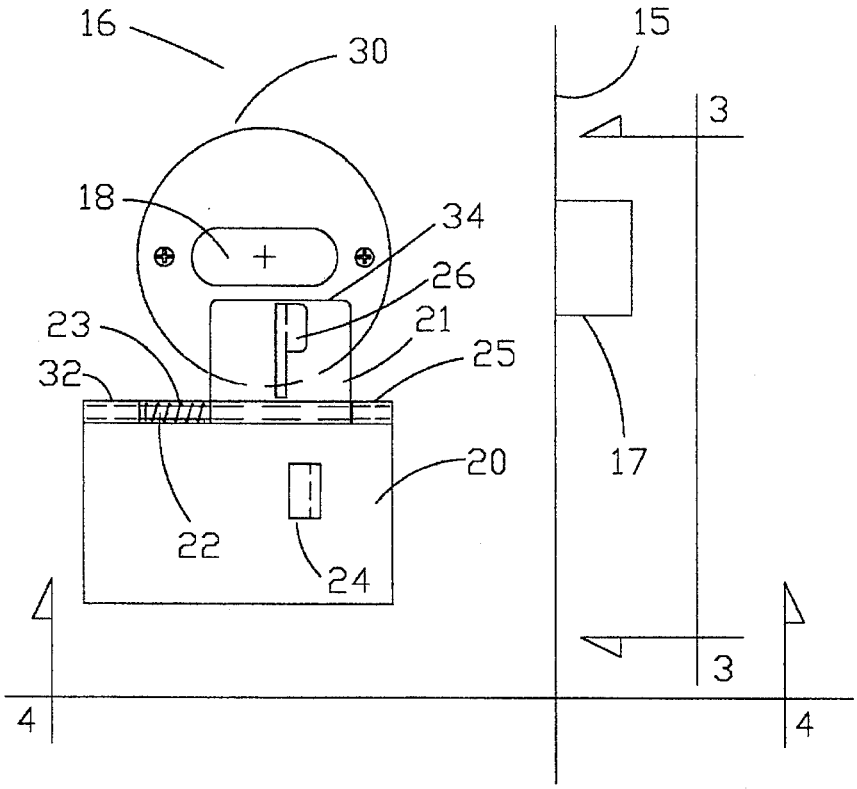
FIG. 2 is a plan view of a key restricting device in the locked or closed position.
Figure 3:
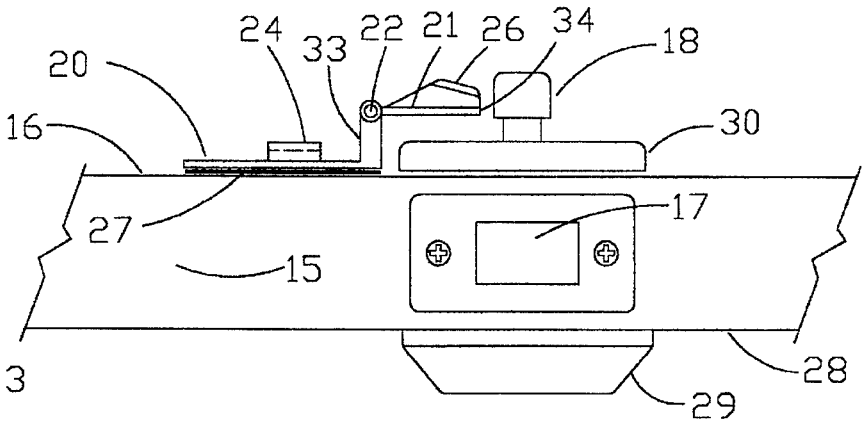
FIG. 3 is an end elevation of FIG. 2.
Figure 4:
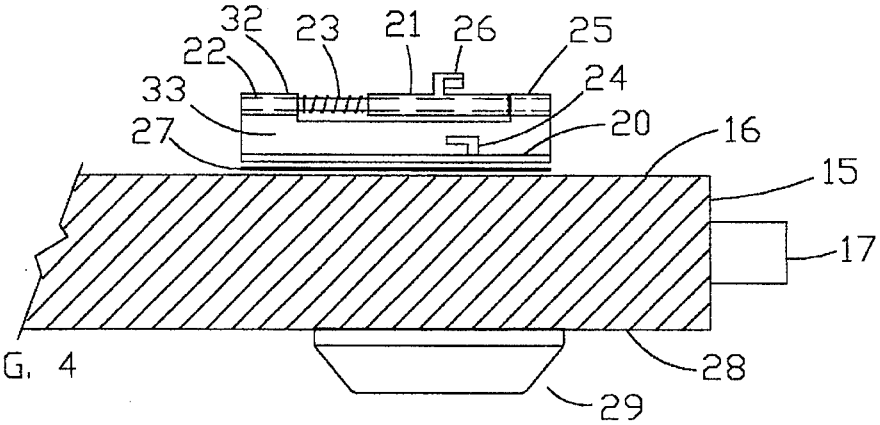
FIG. 4 is a section of FIG. 2.
Figure 6:
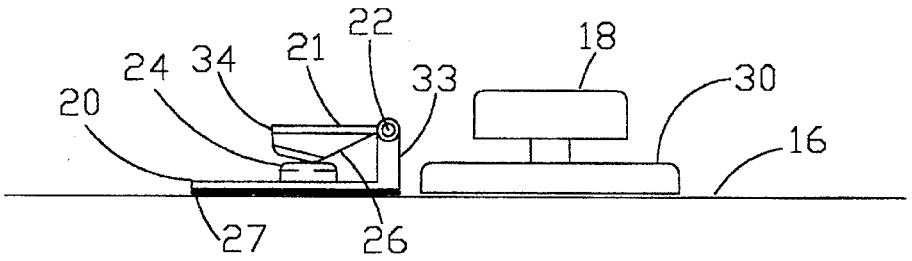
FIG. 6 is a side elevation of FIG. 5
Figure 13:
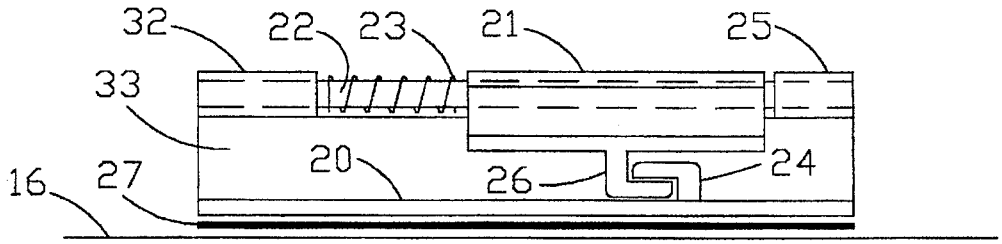
FIG. 13 is a bottom elevation of FIG. 8

The invention will be referred to as device 19. FIGS. 1, 1A and 1B show the relationship of device 19 to the various cylinder operated dead bolt lock components attached to an entry door. FIGS. 1 and 1B show device 19 in the restricting or locked position preventing a dead bolt knob 18 from rotating. FIG. 1A shows device 19 in the open or unrestricted position, this will allow normal operation of cylinder lock 30. The two major components of device 19 are base plate 20 and hinged restraining plate 21. Each of these components has supplementary pads that are an integral pad of that component, for that reason device 19 was designed to be injection molded for ease of manufacture. Base 20 is the main structural support, it is permanently attached to entry door 28 with adhesive 27 shown in FIG. 3. Adhesive 27 would be attached to the bottom of base 20 during manufacturing and would have a protective covering (not shown) that would be removed prior to attaching device 19 to an entry door. An integral part of base 20 is a hinge pin support 33 which is at an angle of 90 degrees to base 20 and elevates hinge pin 22 above the surface of the inside cylinder lock 30. Hinge pin 22 supports both a hinged restraining plate 21 and a positioning spring 23. Plate 21 is attached to hinge pin 22 so that it can rotate 180 degrees around pin 22, this rotation allows device 19 to prevent the turning or unlocking of a locked dead bolt knob 18 as well as permitting normal operation of a cylinder lock without the use of additional pads or having to actually remove device 19 from the door. FIG. 2 and FIG. 3 show plate 21 in the restricting or locked position preventing dead bolt knob 18 from rotating, FIG. 6 shows plate 21 after it has been rotated 180 degrees around pin 22 to the open or non-restricting position. Positioning spring 23 is located on pin 22 between positioning spring stop 32 and plate 21. Pressure applied by spring 23 to plate 21 will keep plate 21 in any given position, this will negate the force of gravity on plate 21 allowing the key restricting device to be attached to a door in what ever position is required to prevent a locked dead bolt knob 18 from rotating. Another integral part of base 20 is a child proof latch hook 24 as shown on FIGS. 2, 3 and 4. Also shown on FIGS. 2, 3 and 4 is a child proof latch 26 which is an integral part of hinged restraining plate 21. Hook 24 and latch 26 interlock to prevent plate 21 from being rotated 180 degrees around pin 22 to the closed or locked position. The interlocking of hook 24 and latch 26 provide a deterrent to prevent a young child from locking the device, the interlocked parts are shown in FIG. 13.

Operation

FIGS. 1, 1A and 1B are shown for explanation and clarification of the invention, it will be referred to as a key restricting device or device 19. Device 19 will prevent a cylinder operated dead bolt lock 29 from being unlocked with a key 31. A cylinder operated dead bolt lock is locked or unlocked from the inside of a room by rotating a dead bolt knob 18 that extends and locks dead bolt 17 as in FIG. 1 or retracts and unlocks bolt 17 into the edge of a door 15 as in FIG. 1A. Dead bolt knob 18 can also be rotated from the outside of an entry door 28 by inserting a key 31 into a cylinder lock 29 and rotating the key. In FIG. 1 device 19 is shown in the restricting or locked position preventing dead bolt knob 18 from rotating. Bolt 17 cannot be unlocked or retracted while knob 18 is prevented from rotating. Most important, when key 31 is inserted into the outside cylinder lock 29 it will not rotate dead bolt knob 18 while device 19 is in the restricting position shown. FIG. 1A shows device 19 in the unlocked or non-restricting position with dead bolt 17 retracted into a door edge 15 and dead bolt knob 18 no longer restrained by a device 19. The position of device 19 shown in FIG. 1A will allow normal operation of a cylinder lock from the inside by rotating a dead bolt knob 18 or from the outside by inserting and rotating a key 31 in a outside cylinder lock 29. Device 19 consists of a base plate 20, hinged restraining plate 21, hinge pin 22, positioning spring 23, child proof latch hook 24, restraining plate stop 25, child proof latch 26, adhesive 27, positioning spring stop 32 and hinge pin support 33 and restricting edge 34. The physical positioning of device 19 would be as shown in FIG. 1. Device 19 is attached to the inside face of door 16 in a position of restraint and in abutment with a locked dead bolt knob 18. The attachment procedure is as follows:

1. Entry door is closed, dead bolt knob 18 is rotated to extend dead bolt 17 to the locked position.
2. Hinged restraining plate 21 is rotated around hinge pin 22 to the restricting position shown in FIG. 1. Force from positioning spring 23 will maintain plate 21 in this position.
3. Protecting covering (not shown) is removed from base 20 to expose adhesive 27.
4. Device 19 is attached to the inside surface of door 16 with restricting edge 34 of plate 21 in close proximity and in abutment with one of the two long sides of knob 18. Since knob 18 is rectangular in shape having two long sides and two narrow sides placing restricting edge 34 in abutment with one long side will prevent rotation.

Device 19 can be attached to the inside face of a door 16 in any semi-circular position around the perimeter of an inside cylinder lock 30 that is required to restrict the rotation of a locked dead bolt knob 18 regardless of the locked angular position. Position arc 35 shown in FIG. 1 illustrates the 180 degrees around the perimeter of an inside cylinder lock 30 required to insure that dead bolt knob 18 will be restricted by device 19 in any angular locked position. This versatility is possible due to positioning spring 23 maintaining force on plate 21 keeping it in a restricting position regardless of the angular position of device 19 around the perimeter of inside cylinder lock 30. Positioning spring 23 negates the force of gravity on plate 21 allowing device 19 to be installed throughout a 180 degree range without the addition or removal of supplemental parts. The 180 degree installation range is very important because the angular locked position of dead bolt knob 18 varies with different manufactures and is not adjustable.

Figure 5:
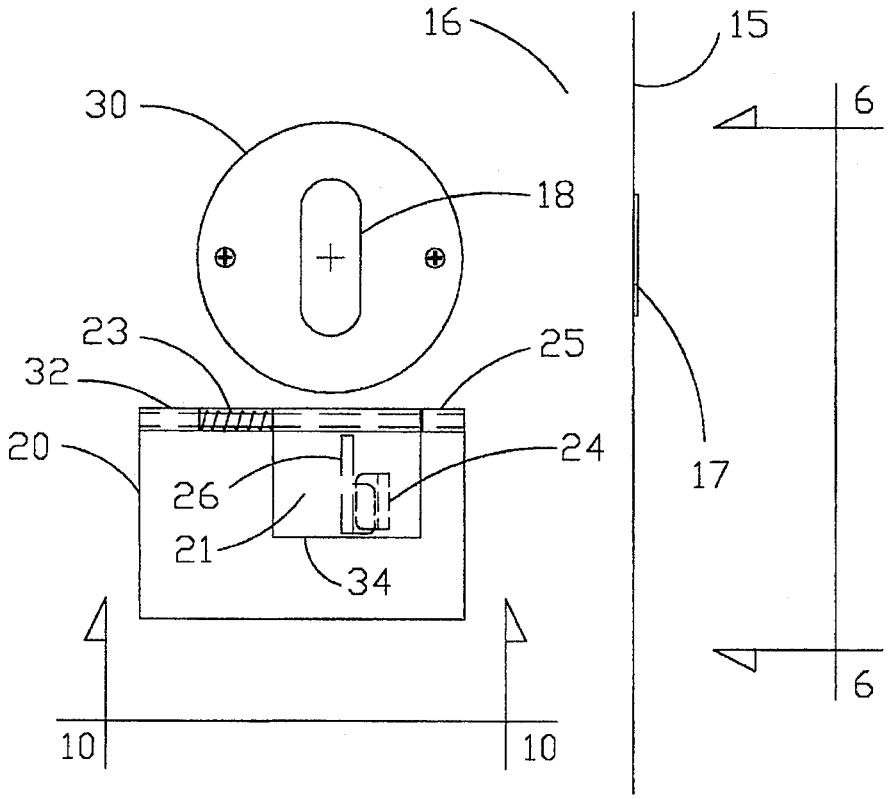
FIG. 5 is a plan view of a key restricting device in the unlocked or open position.
Figure 10:
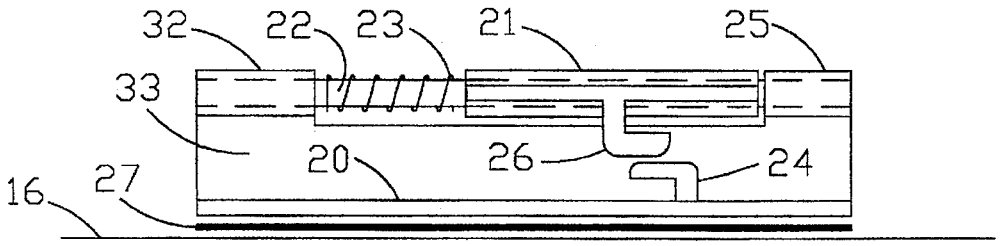
FIG. 10 is a bottom elevation of FIG. 5

FIGS. 1A, 5 and 6 illustrate device 19 in an unrestricted or open position. This position allows normal operation of dead bolt cylinder lock 30, dead bolt knob 18 is not restricted by plate 21 and is free to rotate. Dead bolt 17 can be extended to locked position or retracted to the unlocked position by either dead bolt knob 18 or key 31. To change device 19 from the restricted position shown in FIG. 1 to the unrestricted position shown in FIG. 1A plate 21 is rotated 180 degrees around pin 22 in a direction away from knob 18, spring 23 will force plate 21 against restraining plate stop 25 keeping it in the position shown in FIG. 6. The normal unrestricted or open position of device 19 is illustrated in FIGS. 5, 6 and 10. Child proof latch 26 is an integral part of hinged restraining plate 21 and child proof latch hook 24 is an integral part of base plate 20. Positioning spring 23 forces plate 21 against restraining plate stop 25 preventing latch 26 from locking with hook 24, FIG. 6 and FIG. 10 show latch 26 resting on top of a hook 24. When device 19 is in the unrestricted or open position latch 26 will rest on top of hook 24, pressure from spring 23 will prevent plate 21 from accidently rotating to a locked or closed position as shown in FIG. 1.

Figure 7:
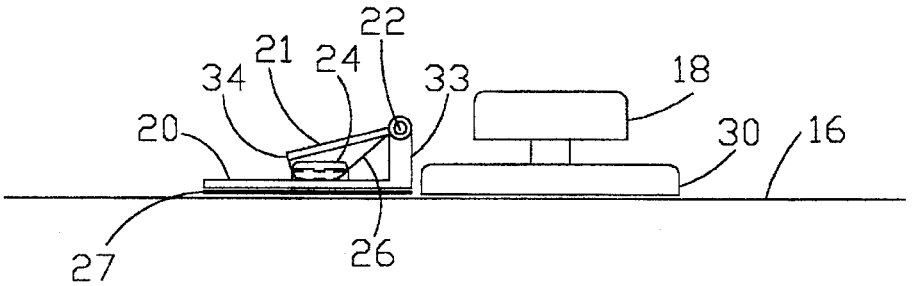
FIG. 7 is a side elevation of FIG. 8
Figure 8:
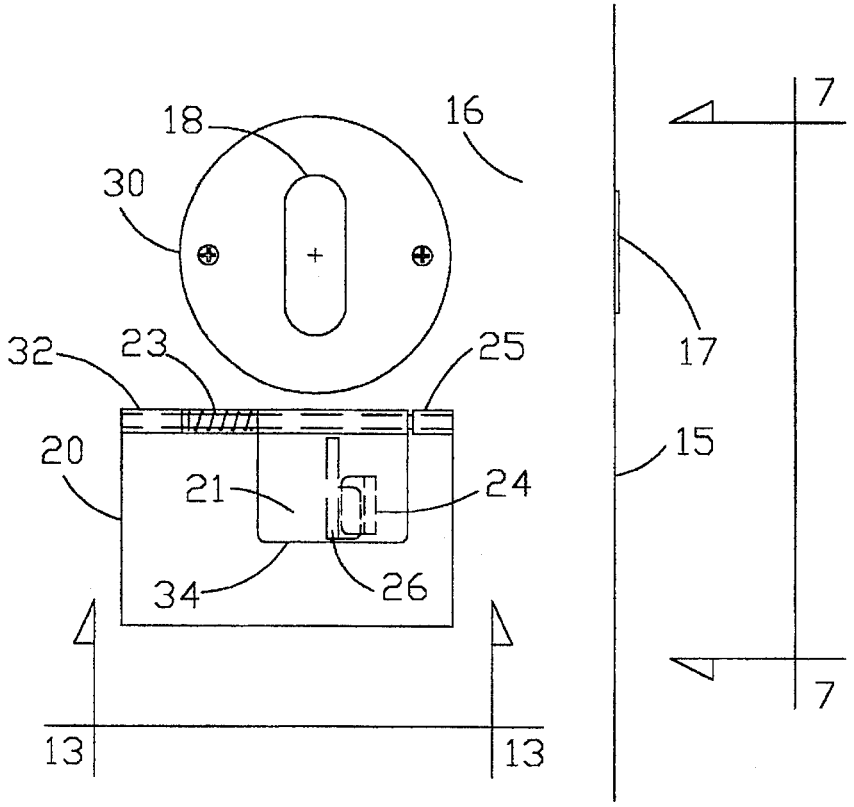
FIG. 8 is a plan view of a key restricting device in the child deterrent position
Figure 9:
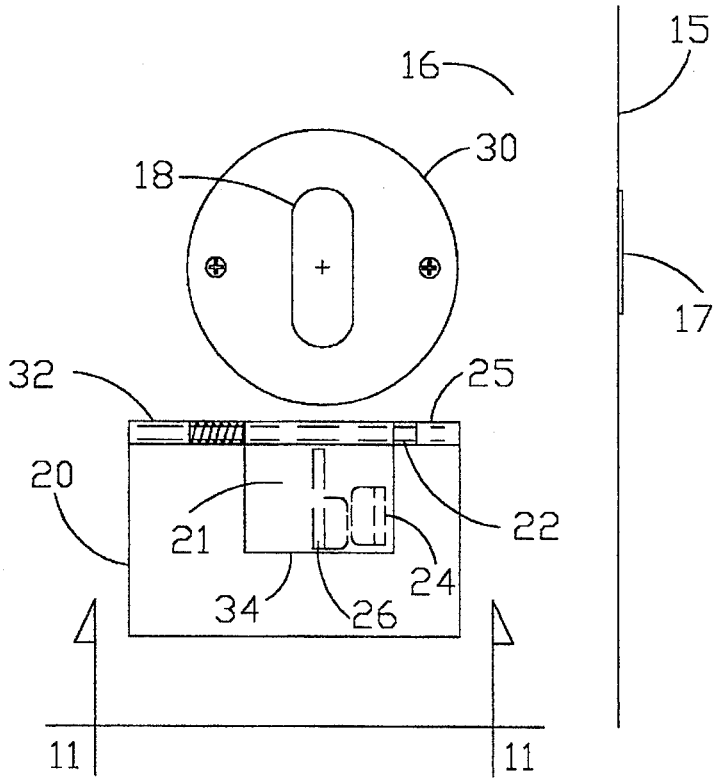
FIG. 9 is a plan view of a key restricting device being changed to the child deterrent position
Figure 11:
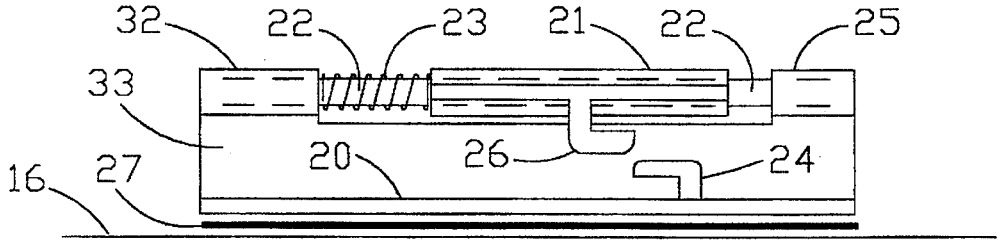
FIG. 11 is a bottom elevation of FIG. 9
Figure 12:
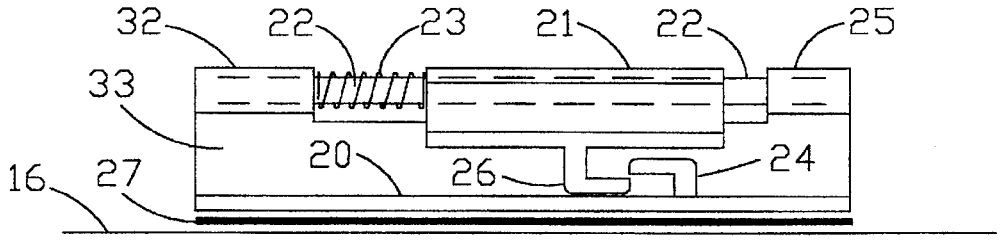
FIG. 12 is a bottom view of a key restricting device being changed to a child deterrent position.

To prevent a young child from rotating plate 21 to a closed or locked position as shown in FIG. 1, device 19 has a child deterrent lock feature. FIGS. 5, 6 and 10 illustrate device 19 in the normal open or unrestricted position, child proof latch 26 is resting on top of child proof latch hook 24, force from spring 23 maintains plate 21 in this position. To engage the child deterrent lock feature latch 26 must be interlocked with hook 24 which requires an individual to execute simultaneous procedures. Spring 23 is compressed by applying pressure to plate 21 in a direction away from restraining plate stop 25 toward positioning spring stop 32 as shown in FIG. 9 and FIG. 11, at the same time, pressure is applied to rotate plate 21 until latch 26 is in contact with base plate 20 as shown in FIG. 12. Pressure on plate 21 is slowly released allowing spring 23 to force plate 21 against restraining plate stop 25 interlocking latch 26 with hook 24. FIGS. 7, 8 and 13 illustrate device 19 in the child deterrent lock position. If this procedure is not executed simultaneously device 19 can not be moved to a child deterrent lock position. Applying pressure to a plate 21 moving it away from restraining plate stop 25 toward spring stop 32 then releasing this pressure will return plate 21 to the original position as shown in FIGS. 5, 6 and 10, latch 26 will be resting on top of hook 24 and the child deterrent lock feature will not be engaged. Also, applying pressure to a plate 21 to force latch 26 against hook 24 will not engage the child deterrent lock feature, latch 26 will remain resting on top of hook 24, this is the normal open or unrestricted position. To remove device 19 from the child deterrent lock position, pressure is applied and maintained to plate 21 to compress spring 23 and to move plate 21 away from restraining plate stop 25, latch 26 is separated from hook 24 as shown in FIG. 12. While maintaining this pressure, plate 21 is rotated away from base plate 20 to the position shown in FIG. 11. When pressure is removed from plate 21 it will be at the position shown in FIG. 10 and latch 26 will be resting on top of hook 24. This is the normal open or unrestricted position of device 19. Plate 21 is free to rotate 180 degrees away from base plate 20 towards dead bolt knob 18 to the closed or restricted position shown in FIG. 1.

Summary:

There are many prior art devices that will prevent a dead bolt cylinder lock from being unlocked with an exterior key. However, much of the prior art lacks the versatility and simplicity of design that device 19 possesses. For instance:

Device 19 can be changed from a position of preventing key entry to a position of allowing normal dead bolt cylinder lock operation with a minimum of effort and thought, very important feature. Some prior art devices require multiple procedures to open a dead bolt lock; others require a separate part. In an emergency it is possible the required part could not be found and the resident could become trapped inside. Device 19 is compact in size, it is always intact and remains attached to a door without being obtrusive.

The child deterrent lock feature is an integral part of device 19. It is always available and does not require the addition or removal of a part to provide this feature.

Device 19 is easy to install as it does not require hand tools or modifications to the existing door. It will prevent a dead bolt knob from rotating regardless of the angular locked position of the knob.

We claim:

1. A key restraining device that will prevent the unlocking of a dead bolt lock from the exterior side of an entry door through the use of a key, comprising:

a) a base plate, a fixed portion of which is attachable to a door in proper relation to an existing rotatable dead bolt knob of said dead bolt lock;

b) a hinged restraining plate that is positionable in parallel conjunction with the rotatable dead bolt knob, the hinged restraining plate being rotatably mounted on a pin, the pin supported by opposing pin supports, each opposing pin support connected to the base plate; and c) a biasing spring surrounding said pin and positioned between one of the opposing pin supports and the hinged restraining plate to bias said hinged restraining plate against the other of the opposing pin supports;

d) whereby said hinged restraining plate can rotate between a first position permitting dead bolt knob rotation and a second position wherein an edge of the hinged restraining plate being substantially parallel to a longitudinal axis of the pin is positioned adjacent the dead bolt knob to prevent dead bolt knob rotation, wherein the hinged restraning plate is slidably mounted to the pin, the base plate has a catch extending therefrom and spaced from said pin supports and said hinged restraining plate has a latch extending therefrom, said catch and latch positioned on said base plate and hinged restraining plate, respectively, so that said catch can engage said latch when the hinged restraining plate is in the first position, latch-catch engagement permitted by slidable movement of said hinged restraining plate on said pin.

2. The key restraining device of claim 1, further comprising an adhesive for connecting the base plate to the door.

3. The key restraining device of claim 1, wherein the base plate and each opposing pin support are integrally connected.

4. The key restraining device of claim 3, wherein each opposing pin support extends upwardly from said base plate to form about a 90° angle.

5. The key restraining device of claim 1, wherein said restraining plate is sized to extend between the pin and a side edge of the dead bolt knob when in the second position.

* * * * *